US008419247B2

(12) United States Patent
Uchida

(10) Patent No.: US 8,419,247 B2
(45) Date of Patent: Apr. 16, 2013

(54) VEHICLE LIGHT

(75) Inventor: Mitsuhiro Uchida, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 246 days.

(21) Appl. No.: 13/034,684

(22) Filed: Feb. 24, 2011

(65) Prior Publication Data

US 2011/0261576 A1 Oct. 27, 2011

(30) Foreign Application Priority Data

Feb. 24, 2010 (JP) ..... 2010-038257

(51) Int. Cl.
*F21V 17/02* (2006.01)

(52) U.S. Cl.
USPC ..... 362/512; 362/539; 362/507; 362/516

(58) Field of Classification Search ..... 362/507, 362/512, 516, 539
See application file for complete search history.

(56) References Cited

U.S. PATENT DOCUMENTS 6,619,827 B2 * 9/2003 Uchida ..... 362/539
6,921,188 B2 7/2005 Taniuchi
7,484,864 B2 * 2/2009 Okada ..... 362/300
2002/0089853 A1 * 7/2002 Taniuchi et al. ..... 362/297
2008/0055920 A1 * 3/2008 Okada ..... 362/539

FOREIGN PATENT DOCUMENTS

JP 2003-331617 A 11/2003

* cited by examiner

*Primary Examiner* — Evan Dzierzynski
(74) *Attorney, Agent, or Firm* — Kenealy Vaidya LLP

(57) ABSTRACT

A vehicle light can include a bulb, a projector lens disposed in front of the bulb and having a focus located in between the bulb and the projector lens. A first reflecting surface can be disposed behind the projector lens, for reflecting light beams emitted from the bulb toward the projector lens so that the light beams are converged at or near the focus of the projector lens. A shade can be configured to shield part of the light beams directed from the first reflecting surface to the projector lens. A second reflecting surface can be disposed on a rear surface of the shade, for reflecting downward part of the reflected light beams directed from the first reflecting surface to the projector lens. A third reflecting surface can be disposed below the shade, for reflecting the light beams from the second reflecting surface to an outside area below the projector lens to project the light beams forward. A decrease in the parts number along with an improvement in light utilization efficiency may be realized with certain embodiments of the invention.

14 Claims, 10 Drawing Sheets

VEHICLE LIGHT

This application claims the priority benefit under 35 U.S.C. §119 of Japanese Patent Application No. 2010-038257 filed on Feb. 24, 2010, which is hereby incorporated in its entirety by reference.

TECHNICAL FIELD

The presently disclosed subject matter relates to a vehicle light. In particular, the presently disclosed subject matter relates to a projector type vehicle light.

BACKGROUND ART

Known projector type vehicle lights have been configured to include a bulb serving as a light source; a projector lens having a focus and disposed in front of the bulb; an elliptical reflector disposed behind the bulb and having a first focus at or near which the bulb is disposed and a second focus at or near which the focus of the projector is disposed; and a shade disposed between the projector lens and the bulb (reflector) and having an upper edge at or near the focus of the projector lens. When the bulb is turned on to emit light beams toward the elliptical reflector, the light beams are reflected by the reflector toward the projector lens. On the way to the projector lens, part of the light beams is shielded by the shade and the remaining part of the light beams is projected forward by the projector lens. The shielding of part of the light beams can form a horizontal bright/dark boundary line in the desired light distribution pattern in front of a vehicle and prevent the light beams from being projected more upward than the bright/dark boundary line. Accordingly, the desired light distribution pattern, for example, for low beam of a vehicle light can be formed while suppressing the occurrence of glare light with respect to an opposed vehicle.

In this configuration, however, the utilization efficiency of light from the bulb may deteriorate due to the shielding of the reflected light beams by the shade. To cope with this problem, for example, Japanese Patent Application Laid-Open No. 2003-331617 (corresponding to U.S. Pat. No. 6,921,188) discloses a projector type vehicle light that can improve the light utilization efficiency. The technology disclosed in this Japanese publication includes a first reflector provided obliquely in front of an elliptical reflector, and another (second) reflector provided below the first reflector. In addition, still another third reflector is provided in front of the second reflector. According to this technology, the light beams emitted from a bulb obliquely upward and forward cannot enter the elliptical reflector, but can be directly reflected by the first reflector, and then sequentially reflected by the second reflector and the third reflector, whereby the reflected light beams may be projected forward and obliquely sideward.

Accordingly, in this technology disclosed in the publication, the light beams that do not enter the elliptical reflector can only be reflected by the first reflector, but the light beams that are shielded by the shade cannot be utilized efficiently. This results in still low light utilization efficiency. In addition to this, the projector type vehicle light needs three additional reflectors other than the elliptical reflector, thereby increasing the parts number. This may increase the entire costs as well as manufacturing costs.

SUMMARY

The presently disclosed subject matter was devised in view of these and other problems and features and in association with the conventional art. According to an aspect of the presently disclosed subject matter, the parts number of a vehicle light can be decreased while light utilization efficiency can be improved.

According to another aspect of the presently disclosed subject matter, a vehicle light can include: a light source such as a bulb, an LED, and the like; a projector lens disposed in front of the light source and having an optical axis in a front-to-rear direction of a vehicle body to which the vehicle light is to be installed and a focus located in between the light source and the projector lens; a first reflecting surface disposed behind the projector lens, the first reflecting surface reflecting light beams emitted from the light source toward the projector lens so that the reflected light beams are converged at or near the focus of the projector lens; a light-shielding member such as a shade having an upper edge at or near the focus of the projector lens, the light-shielding member shielding part of the reflected light beams directed from the first reflecting surface to the projector lens; a second reflecting surface disposed on a rear surface of the light-shielding member and reflecting part of the reflected light beams directed from the first reflecting surface to the projector lens to direct the light beams in a direction outward from the optical axis of the projector lens; and a third reflecting surface disposed in the direction outward from the optical axis of the projector lens and reflecting the light beams reflected by the second reflecting surface to an outside area around and below the projector lens to project the light beams forward.

In the above vehicle light, the second reflecting surface can reflect the part of the reflected light beams directed from the first reflecting surface to the projector lens to direct the light beams downward, and the third reflecting surface can be disposed below the light-shielding member so as to reflect the light beams reflected by the second reflecting surface to the outside area below the projector lens to project the light beams forward.

The light-shielding member can be configured to be movable between a light-shielding position where the upper edge thereof is located at or near the focus of the projector lens and a retracted position where the upper edge thereof is located away from and below the focus of the projector lens.

The vehicle light can further include a driving mechanism for moving the light-shielding member between the light-shielding position and the retracted position.

In the abovementioned configuration, the second reflecting surface can be provided to the light-shielding member, and any separate component for installing the second reflecting surface is not required. This can decrease the parts number for the vehicle light, thereby decreasing the entire cost as well as manufacturing cost.

In the abovementioned configuration, the light beams shielded by the light-shielding member can be reflected by the second reflecting surface in the direction outward from the optical axis so as to be further reflected by the third reflecting surface to the front. Accordingly, the light beams that have typically been wasted (for example, in the conventional configuration) can be efficiently utilized to increase the light utilization efficiency as well as to form a brighter light distribution pattern.

The second reflecting surface can be provided at the rear surface of the light-shielding member and the light-shielding member can be disposed at or near the focus of the projector lens. In this configuration, the light beams reflected by the first reflecting surface can be converged at or near the focus of the projector lens. Accordingly, even if the area of the second reflecting surface is small, the converged light beams with a large intensity can be reflected by the small second reflecting surface. Furthermore, as the small second reflecting surface can sufficiently reflect the converged light beams, the miniaturization of the entire vehicle light can be facilitated.

BRIEF DESCRIPTION OF DRAWINGS

These and other characteristics, features, and advantages of the presently disclosed subject matter will become clear from the following description with reference to the accompanying drawings, wherein.

DESCRIPTION OF EXEMPLARY EMBODIMENTS

A description will now be made below to vehicle lights of the presently disclosed subject matter with reference to the accompanying drawings in accordance with exemplary embodiments. It should be noted that the following exemplary embodiments will have various technical features described for illustrating the achievement of the presently disclosed subject matter, which should not limit the scope of the present invention to the following exemplary embodiment and the illustrated examples in no way.

It should be appreciated that the following descriptions will be given with directions of "up," "down (low)," "front," "back (rear)," "left," and "right," in some cases and the directions will be based on the directions when the vehicle light is installed on a vehicle body. This means the directions are given on the basis of a driver's view.

Figure 1:
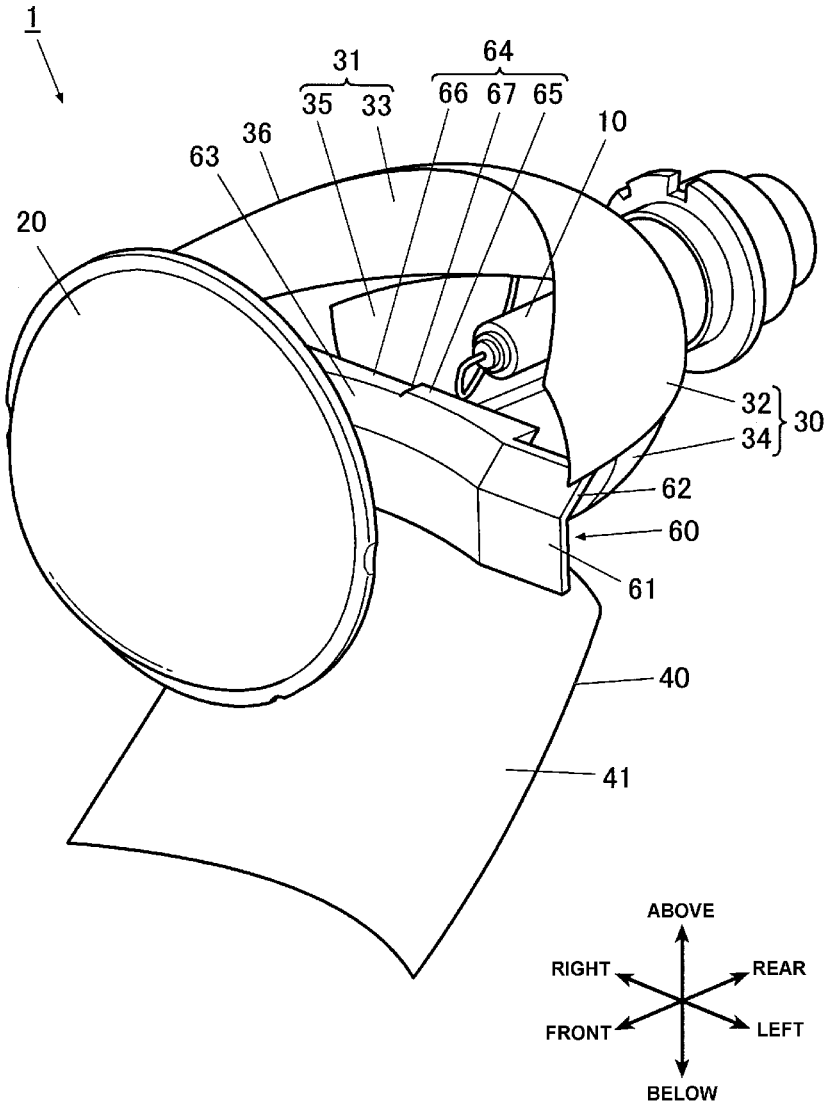
FIG. 1 is a perspective view of a vehicle light according to a first exemplary embodiment made in accordance with principles of the presently disclosed subject matter.
Figure 2:
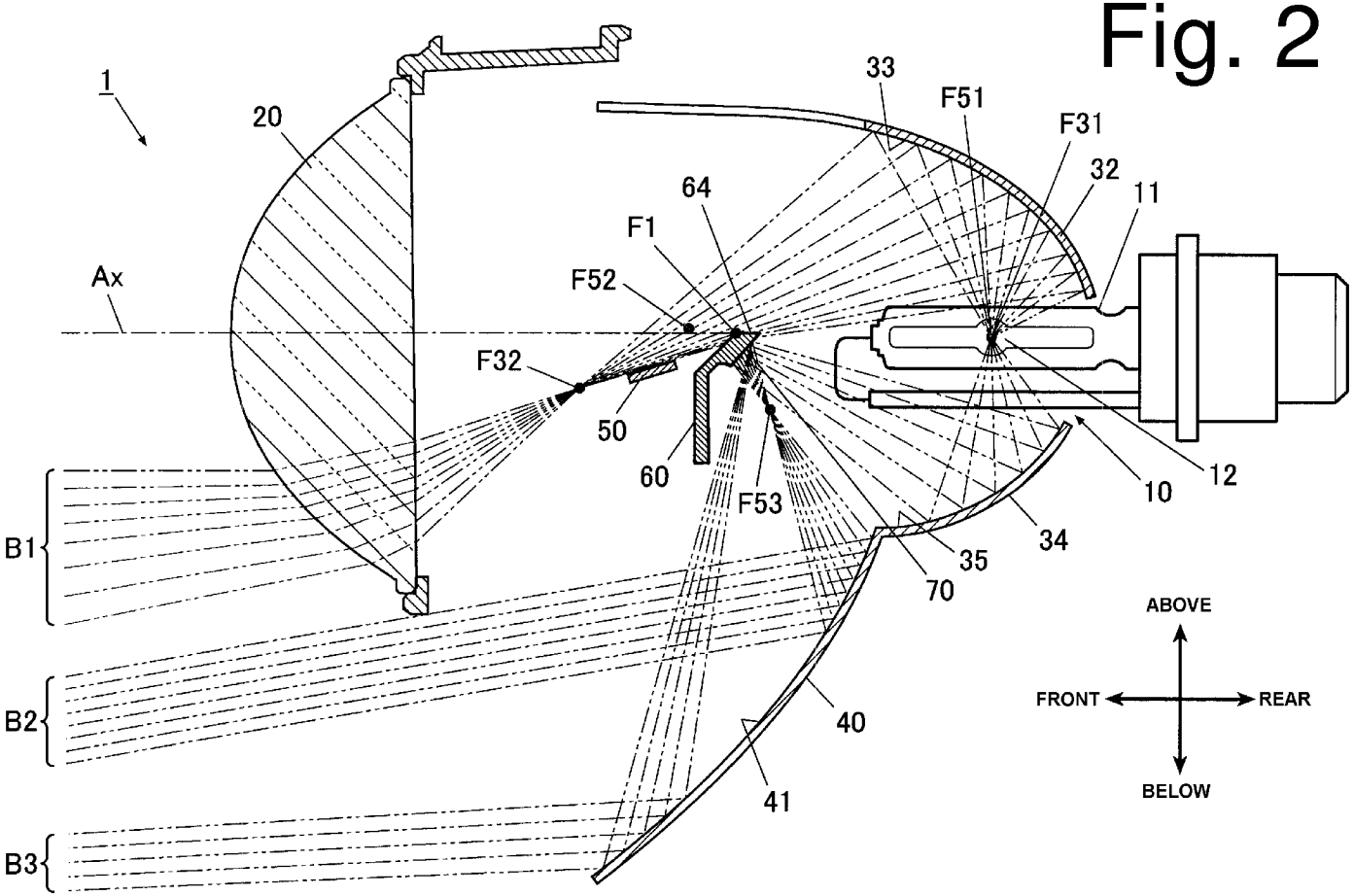
FIG. 2 is a cross sectional view of the vehicle light of FIG. 1.

FIG. 1 is a front perspective view of a vehicle light 1. FIG. 2 is a vertical cross sectional view of the vehicle light 1 taken along an optical axis Ax.

The vehicle light 1 can be utilized as a vehicle headlamp, for example. Of course, the presently disclosed subject matter is not limited thereto, and is applicable to, not only a vehicle headlamp, but to a fog lamp, a signal lamp, a turning lamp, a rear lamp, projector lamps, utility lamps, and the like.

The vehicle light 1 can include a light source such as a bulb 10, a projector lens 20, an elliptical reflector 30, a parabolic reflector 40, an overhead-sign light distribution reflector 50, a light-shielding member or a shade 60, and a reflecting surface 70 formed on the shade 60. The vehicle light 1 can further include a housing (not shown) to which the projector lens 20, the elliptical reflector 30, the parabolic reflector 40, the overhead-sign light distribution reflector 50, and the shade 60 can be attached. Specifically, the bulb 10, the projector lens 20, the elliptical reflector 30, the parabolic reflector 40, the overhead-sign light distribution reflector 50, and the shade 60 can be united as a single unit. In FIG. 1, the overhead-sign light distribution reflector 50 is not illustrated in order to show the shade 60 clearly.

The projector lens 20 can be configured to include a convex lens. The projector lens 20 has an optical axis Ax extending in a front-to-rear direction of a vehicle body (not shown) to which the vehicle light is installed. The projector lens 20 can have a focus F1 in back thereof. In back of the projector lens 20, there are provided the bulb 10, the elliptical reflector 30, the parabolic reflector 40, the overhead-sign light distribution reflector 50, and the shade 60 in place.

The bulb 10 can be a discharge lamp such as a high intensity discharge lamp (HID) and a high pressure metal vapor discharge lamp, a halogen lamp, an incandescent lamp, and the like. In the illustrated example, the bulb 10 can have a glass tube 11 and a light emission portion 12 housed therein. The bulb 10 can be disposed so that the lengthwise direction of the glass tube 11 of the bulb 10 is aligned with the optical axis Ax (front-to-rear direction), and the light emission portion 12 of the bulb 10 can be disposed in back of the focus F1 of the projector lens 20. It should be noted that the light emission portion 12 can be a light emission tube (discharge portion) when the bulb 10 is a discharge lamp whereas it can be a filament when the bulb 10 is a halogen lamp or an incandescent lamp. It should be further noted that the lengthwise direction of the glass tube 11 of the bulb 10 may be arranged so as to cross with respect to the optical axis Ax. For example, the bulb 10 can be disposed so that the lengthwise direction of the glass tube 11 is aligned with the right-to-left direction.

The elliptical reflector 30 can be formed as a cup-like shape and be opened forward. The inner surface 31 of the elliptical reflector 30 can serve as a first reflecting surface 31. The first reflecting surface 31 can be configured to reflect light beams emitted from the light emission portion 12 of the bulb 10 to the projector lens 20 disposed in front of the bulb 10 and to converge the reflected light beams at or near the focus F1 of the projector lens 20.

The first reflecting surface 31 can be designed on the basis of the elliptical surface. The elliptical surface can mean a spheroid or a revolved ellipsoid around a center axis as a rotation axis extending in the front-to-rear direction or an oblate spheroid, or a free curved surface based on these spheroids. The oblate spheroid can refer to one prepared by smashing a revolved ellipsoid around a center rotation axis extending in the front-to-rear direction vertically or horizontally, for example. The first reflecting surface 31 can be a complex ellipsoid by combining these revolved ellipsoid, oblate spheroid, and free curved surface.

The elliptical reflector 30 can be configured in the following manner. Specifically, the elliptical reflector 30 can include an upper reflector 32 and a lower reflector 34. The upper reflector 32 can be formed into a substantially domed shape covering the light emission portion 12 of the bulb 10 from the position behind the light emission portion 12 to the horizontally wide-ranged positions obliquely above and slightly before the light emission portion 12. The lower reflector 34 can be formed into a substantially domed shape covering the light emission portion 12 of the bulb 10 from the position behind the light emission portion 12 to the horizontally wide-ranged positions obliquely below and slightly before the light emission portion 12.

The upper reflector 32 can have an inner surface 33 serving as an upper reflecting surface, and the lower reflector 34 can have an inner surface 35 serving as a lower reflecting surface. The combination of the upper and lower reflecting surfaces 33 and 35 can constitute the first reflecting surface 31. The upper reflecting surface 33 can be an oblate spheroid prepared by smashing a revolved ellipsoid around a center rotation axis extending in the front-to-rear direction vertically or horizontally or a free curved surface formed on the basis of such an oblate spheroid. The lower reflecting surface 35 can be a revolved ellipsoid around a center rotation axis extending in the front-to-rear direction or a free curved surface formed on the basis of such a revolved ellipsoid. The oblateness of the upper reflecting surface 33 in the vertical direction can be made larger than that of the lower reflecting surface 35, so that the upper reflecting surface 33 is wider than the lower reflecting surface 35 in the horizontal direction.

The upper reflecting surface 33 can have a rear side focus or a first focus F31 and a front side focus or a second focus F32. The rear side focus F31 can be disposed inside the upper reflecting surface 32 and the front side focus F32 can be disposed before the rear side focus F31. The lower reflecting surface 35 can have a rear side focus or a first focus F51 and a front side focus or a second focus F52. The rear side focus F51 can be disposed inside the lower reflecting surface 35 and the front side focus F52 can be disposed before the rear side focus F51. Since the upper reflecting surface 33 can be formed on the basis of an oblate spheroid or a free curved surface based on an oblate spheroid, the front side focus F32 can be a horizontally wide focus as well as curved rearward. In the same manner, the rear side focus F52 of the lower reflecting surface 35 can be a horizontally wide focus as well as curved rearward.

The rear side foci F31 and F51 of the upper reflecting surface 33 and the lower reflecting surface 35 can be disposed at or near the light emission portion 12 of the bulb 10. The rear side focus F31 of the upper reflecting surface 33 can overlap with the rear side focus F51 of the lower reflecting surface 35, and furthermore, the rear side foci F31 and F51 can overlap the light emission portion 12.

The front side foci F32 and F52 of the upper and lower reflecting surfaces 33 and 35 can be disposed on or near (i.e., substantially at) the focus F1 of the projector lens 20. In a one mode, the front side focus F32 of the upper reflecting surface 33 can be located before the focus F1 of the projector lens 20 and behind the projector lens 20, and the front side focus F52 of the lower reflecting surface 35 can be located nearer the focus F1 of the projector lens 20 than the front side focus F32. In another mode, the front side focus F52 of the lower reflecting surface 35 can be located before the focus F1 of the projector lens 20 and behind the projector lens 20.

As described above, the first reflecting surface 31 can be a composite ellipsoid of the upper reflecting surface 33 and the lower reflecting surface 35, and accordingly, the front focus (second focus) of the first reflecting surface 31 can appear as if at the front foci F32 and F 52. In this configuration, the upper reflecting surface 33 can reflect the light beams from the light emission portion 12 to the projector lens 20 positioned in front thereof and converge the reflected light beams to the front side focus F32. Further, the lower reflecting surface 35 can reflect the light beams from the light emission portion 12 to the projector lens 20 positioned in front thereof and converge the reflected light beams to the front side focus F52. It should be noted that if the first reflecting surface 31 is not a composite ellipsoid of the upper reflecting surface 33 and the lower reflecting surface 35 but a single ellipsoid, the first reflecting surface 31 can have a rear side focus or a first focus located at or near (i.e., substantially at) the light emission portion 12 of the bulb 10 and a front side focus at or near the focus F1 of the projector lens 20.

The light-shielding member or shade 60 can be disposed in between the bulb 10 and the projector lens 20. The shade 60 can block part of the light beams from the bulb 10 or part of the light beams reflected by the first reflecting surface 31 at or near the focus F1 of the projector lens 20, so that the bright/dark boundary line can be formed in a desired light distribution pattern.

Figure 3:
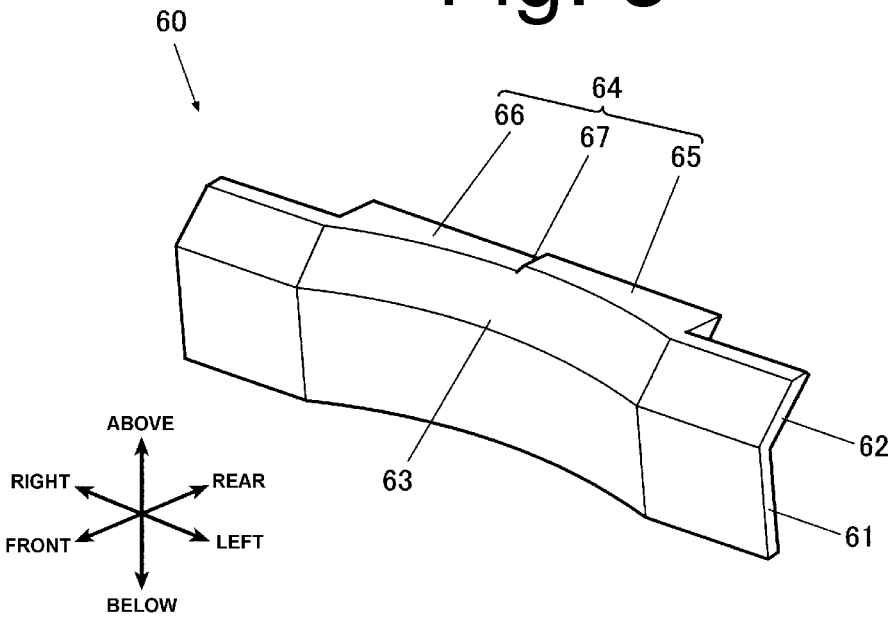
FIG. 3 is a front-side perspective view of a light-shielding member (shade) in the vehicle light of FIG. 1.
Figure 4:
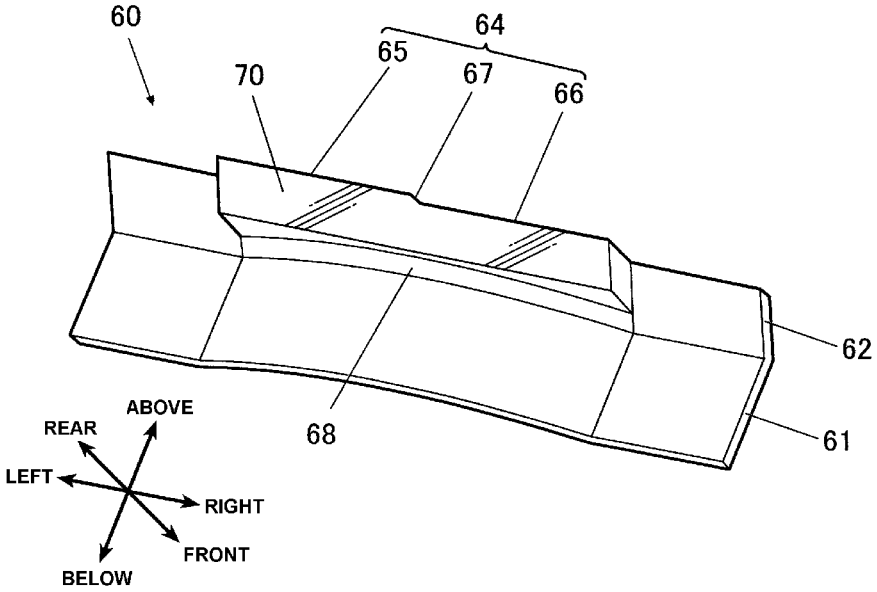
FIG. 4 is a rear-side perspective view of the light-shielding member in the vehicle light of FIG. 1.

FIG. 3 is a front-side perspective view illustrating the shade 60, and FIG. 4 is a rear-side perspective view of the same. As shown in FIGS. 1 to 4, the shade 60 can be formed of a plate and disposed in an erected position. Specifically, the shade 60 can be composed of a lower portion 61 in a vertical posture and an upper portion 62 extending from the upper edge of the lower portion 61 inclined rearward. The front surface 63 of the shade 60 can be curved rearward corresponding to the imaging surface of the projector lens 20. The shade 60 can have an upper edge 64 and can be disposed between the projector lens 20 and the bulb 10 so that the upper edge 64 is located at or near the focus F1 of the projector lens 20.

The upper edge 64 of the shade 60 can be divided into three portions, including a portion 65 located on the left side of the optical axis Ax (hereinafter, referred to as "left upper edge 65") and formed horizontally, a portion 66 located on the right side of the optical axis Ax (hereinafter, referred to as "right upper edge 66") and formed horizontally, and a portion 67 located between the left upper edge 65 and the right upper edge 66 (hereinafter, referred to as "inclined edge 67") and including a stepped portion between the left upper edge 65 and the right upper edge 66 and inclined with respect to the horizontal direction. The inclination angle of the inclined edge 67 can be 15° and 45° with respect to the horizontal direction.

In the illustrated example, the upper edge 64 of the shade 60 can have a portion nearer the traveling lane side than the optical axis Ax and being higher than the other portion nearer the opposed (or oncoming) lane side. Specifically, when the vehicle light 1 is applied to a left-hand traffic system, the left upper edge 65 can be disposed further above than the right upper edge 66, and the inclined edge 67 can be inclined rightward. Accordingly, the illustrated shade 60 is designed to be suitable for the left-hand traffic system. On the other hand, if the vehicle light 1 is applied to a right-hand traffic system, the right upper edge 66 can be disposed further above than the left upper edge 65 and the inclined edge 67 can be inclined leftward.

It should be noted that the left upper edge 65 and the right upper edge 66 can be flush with each other without the inclined edge 67.

The second reflecting surface 70 can be formed on an upper portion of the rear surface 68 of the shade 60 at its horizontal center. Specifically, the second reflecting surface 70 can be directed rearward and obliquely downward. Accordingly, the second reflecting surface 70 can be formed in a horizontally wide band shape along the upper edge 64 of the shade when viewed from its rear side. The second reflecting surface 70 may be a curved surface such as a convex surface, a concave surface, a cylindrical surface, and a spherical surface, or a free curved surface (aspherical surface) based on these surfaces.

The second reflecting surface 70 can reflect part of the light beams that are reflected by the first reflecting surface 31 toward the projection lens 20 to direct the light beams downward. Specifically, the second reflecting surface 70 can reflect almost all the light beams reflected by the lower reflecting surface 35 to direct the light beams rearward. This means the front side focus F52 of the lower reflecting surface 35 can be changed in location with respect to the focus F53 and positioned behind the second reflecting surface and obliquely downward. Namely, the lower reflecting surface 35 and the second reflecting surface 70 can constitute another optical system including the focus F53 located below the optical axis Ax, so that the part of the light beams reflected by the first reflecting surface 31 can be converged to the focus F53.

As shown in FIGS. 1 and 2, the parabolic reflector 40 can be disposed below the shade 60 and the second reflecting surface 70. The parabolic reflector 40 and the elliptical reflector 30 can be integrated to form a single unit. Specifically, the parabolic reflector 40 can be formed so as to suspend from the front edge of the lower reflector 34 downward and continue with the same at its upper edge. The third reflecting surface 41 can be located behind the projector lens 20. In this configuration, the first reflecting surface 41 can be viewed in such a manner that the third reflecting surface 41 is shifted from the projector lens 20.

The parabolic reflector 40 can have a front-side inner surface 41 serving as the third reflecting surface. Namely, the third reflecting surface 41 can be formed of a parabolic shape. It should be noted that the "parabolic surface" used herein can refer to a revolved paraboloid around a center rotation axis extending in the front-to rear-direction or a free curved surface based on the revolved paraboloid. The third reflecting surface 41 can have a focus at or near the focus F1 of the projector lens 20. In one mode, the focus of the third reflecting surface 41 can be located slightly behind the focus F1 of the projector lens 20 and below the optical axis Ax. In a still another mode, the focus of the third reflecting surface 41 can overlap with the focus F53 of the optical system composed of the lower reflecting surface 35 and the second reflecting surface 70.

The third reflecting surface 41 can reflect the light beams reflected downward by the second reflecting surface to direct the light beams forward. The light beams reflected by the third reflecting surface 41 can be projected forward while passing through the area below the projector lens 20.

The overhead-sign light distribution reflector 50 can be disposed in front of the shade 60. The overhead-sign light distribution reflector 50 can be used to reflect part of the reflected light beams that are not shielded by the shade 60 to direct the light beams toward the projector lens 20, thereby forming an overhead-sign light distribution.

Figure 5:
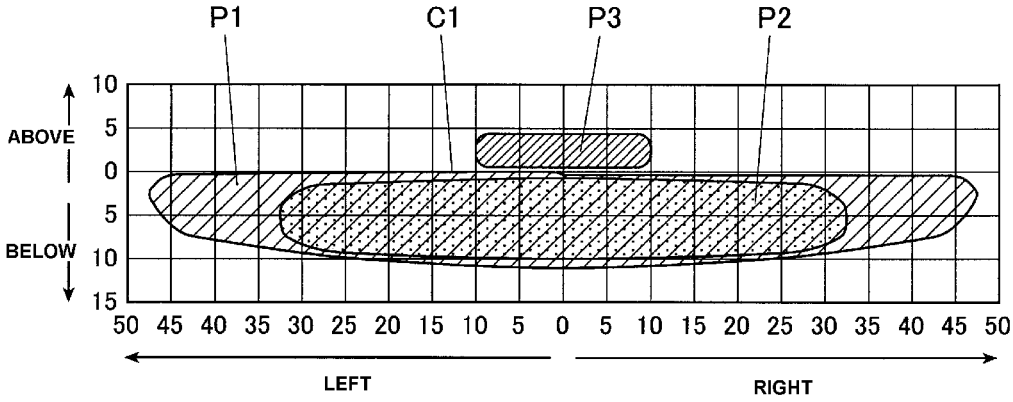
FIG. 5 is a chart showing a low beam light distribution pattern formed on a virtual screen in front of the vehicle light of FIG. 1.

With reference to FIG. 5, a description will be given of the light distribution characteristics of the exemplary vehicle light 1. FIG. 5 is a chart showing a light distribution pattern formed on a virtual screen in front of the vehicle light 1 and located a predetermined distance away therefrom. In FIG. 5, the horizontal axis represents horizontal angles and the vertical axis represents vertical angles with respect to the intersection of the optical axis Ax with the virtual screen as zero degrees.

When the bulb 10 is energized, the light emission portion 12 can emit light beams. The light beams from the light emission portion 12 can reach the first reflecting surface 31 to be reflected forward. Part of the light beams can be shielded by the shade 60. The remaining part of the light beams can pass over the shade 60 without shielding and then enter the projector lens 20 to be projected forward by the projector lens 20. The shielding of light beams by the shade 60 can form the light distribution pattern P1 on the virtual screen as shown in FIG. 5. The light distribution pattern P1 can include a clear cut-off line C1 or a bright/dark boundary line as a horizontal line at a vertical degree of zero degrees (a crossing line between a horizontal plane with the virtual screen passing through the optical axis Ax). The light beams for forming the bright area of the light distribution pattern P1 can be light beams emitted from the light emission portion 12 upward and reflected by the upper reflecting surface 33 (refer to the light beams B1 shown in FIG. 2). When the bulb 10 is an HID, the bright area of the light distribution pattern P1 is white because the light beams emitted upward from the light emission portion 12 are white.

The reflected light beams passing over the shade 60 without being shielded by the shade 60 can be reflected by the overhead-sign light distribution reflector 50, and can be projected through the projector lens 20 above the horizontal plane passing through the optical axis Ax. Accordingly, an overhead-sign light distribution pattern P3 can be formed as shown in FIG. 5.

Part of the light beams reflected by the first reflecting surface 31 can be reflected by the second reflecting surface 70 to be directed downward to the third reflecting surface 41. The reflected light beams from the second reflecting surface 70 can be reflected by the third reflecting surface 41 forward so as to become substantially parallel light beams. Then, the reflected light beams from the third reflecting surface 41 can be projected while passing by and below the projector lens 20. In this way, as shown in FIG. 5, a light distribution pattern P2 can be formed on the virtual screen. The main bright area of the light distribution pattern P2 can be located below the horizontal plane passing through the optical axis Ax. Accordingly, the main bright area of the light distribution pattern P2 can be overlaid on the bright area of the light distribution pattern P1. Namely, the combination of the light distribution patterns P1 and P2 can form the low beam light distribution pattern. Note that the bright area of the light distribution pattern P1 can be wider than that of the light distribution pattern P2 in the horizontal direction.

The light beams for forming the bright area of the light distribution pattern P2 can be light beams emitted from the light emission portion 12 downward and reflected by the lower reflecting surface 35 (refer to the light beams B2 shown in FIG. 2). In addition, part of the light beams reflected by the upper reflecting surface 33 can be directed downward by the second reflecting surface 70, so that the bright area of the light distribution pattern P2 can be formed thereby (refer to the light beams B3 shown in FIG. 2). A larger amount of the reflected light beams from the upper reflecting surface 33 can pass over the shade 60 to contribute the formation of the bright area of the light distribution pattern P2 (more than the light beams reflected by the lower reflecting surface 35). Note that when the bulb 10 is an HID, the light beams emitted from the light emission portion 12 downward is yellow, and the bright area of the light distribution pattern P2 may be yellow.

According to the presently disclosed subject matter, the second reflecting surface 70 can be formed on the rear surface of the shade 60. Since the shade 60 can be located near the front side focus (front side focus F32, F52) of the first reflecting surface 31, the light beams that are reflected and converged by the first reflecting surface 31 can enter the second reflecting surface 70. Accordingly, even when the second reflecting surface 70 has a small area, the second reflecting surface 70 can reflect light beams with a large intensity. Since the second reflecting surface 70 may have a smaller area, the miniaturization of the vehicle light 1 can be achieved.

In addition to this, since the second reflecting surface 70 can be disposed between the bulb 10 and the projector lens 20, an increase in size can be suppressed.

Furthermore, since the second reflecting surface 70 can be formed on the shade 60, there is no separate reflector for the second reflecting surface 70. Accordingly, the parts number for the vehicle light 1 can be reduced, thereby achieving cost cutting.

When a shade is provided, the light beams shielded by the shade cannot be utilized. In the present configuration, however, the light beams shielded by the shade 60 can be reflected by the second reflecting surface that is provided on the rear surface of the shade 60 to be directed downward for the formation of the low beam light distribution pattern. Accordingly, the light utilization efficiency of light beams from the light emission portion 12 can be improved.

The reflected light beams from the first reflecting surface 31 can be reflected by the second reflecting surface 70 to be directed downward to the third reflecting surface 41. Accordingly, even if the distance between the second reflecting surface 70 and the third reflecting surface 41 is short, the reflected light beams by the third reflecting surface 41 are not affected by interference between the projector lens 20 and its lens holder and the like, whereby the illuminated area by the reflected light beams by the third reflecting surface 41 can be located below the horizontal plane passing through the optical axis Ax (see FIG. 5). This means the distance between the second reflecting surface 70 and the third reflecting surface 41 can be shortened, whereby the vertical dimension of the vehicle light 1 can be reduced.

In the above configuration, the bright area of the light distribution pattern P2 can be overlaid on the bright area of the light distribution pattern P1, thereby providing a brighter light distribution pattern with improved front visibility. In particular, when the bulb 10 is an HID, the yellowish bright area being the bright area of the light distribution pattern P2 can be overlaid on the whitish bright area being the bright area of the light distribution pattern P1, thereby suppressing the occurrence of color unevenness.

Figure 6:
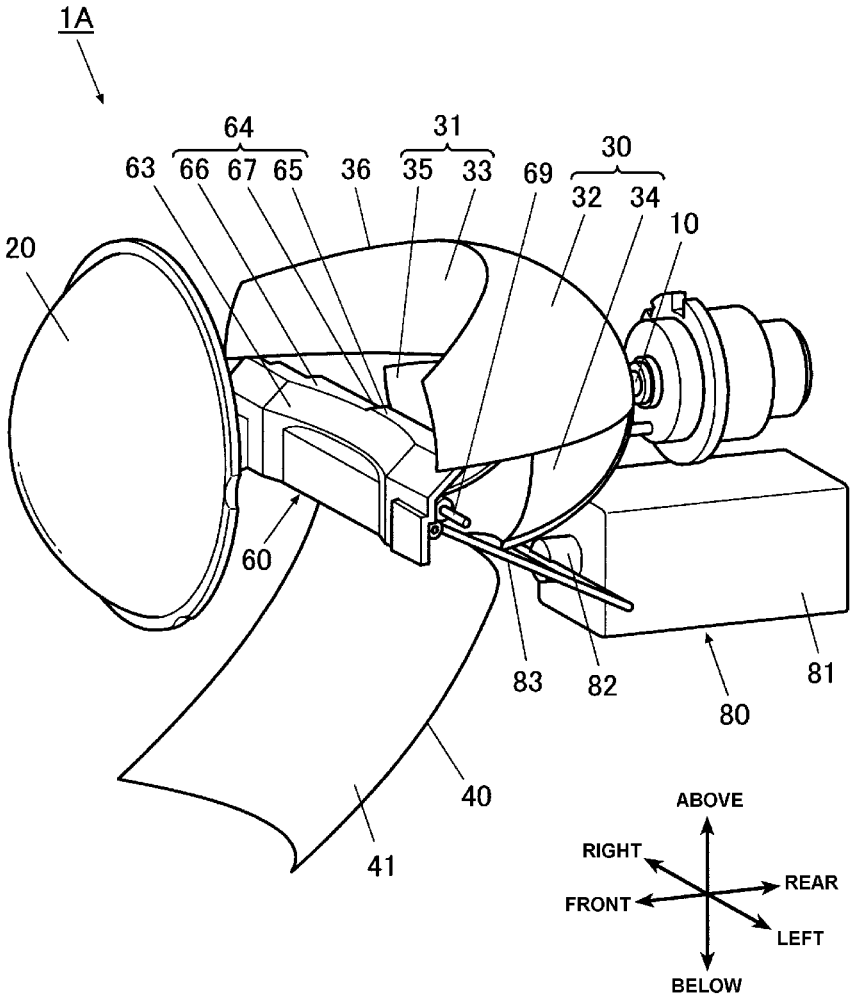
FIG. 6 is a front-side perspective view of a vehicle light according to another exemplary embodiment made in accordance with principles of the presently disclosed subject matter.
Figure 7:
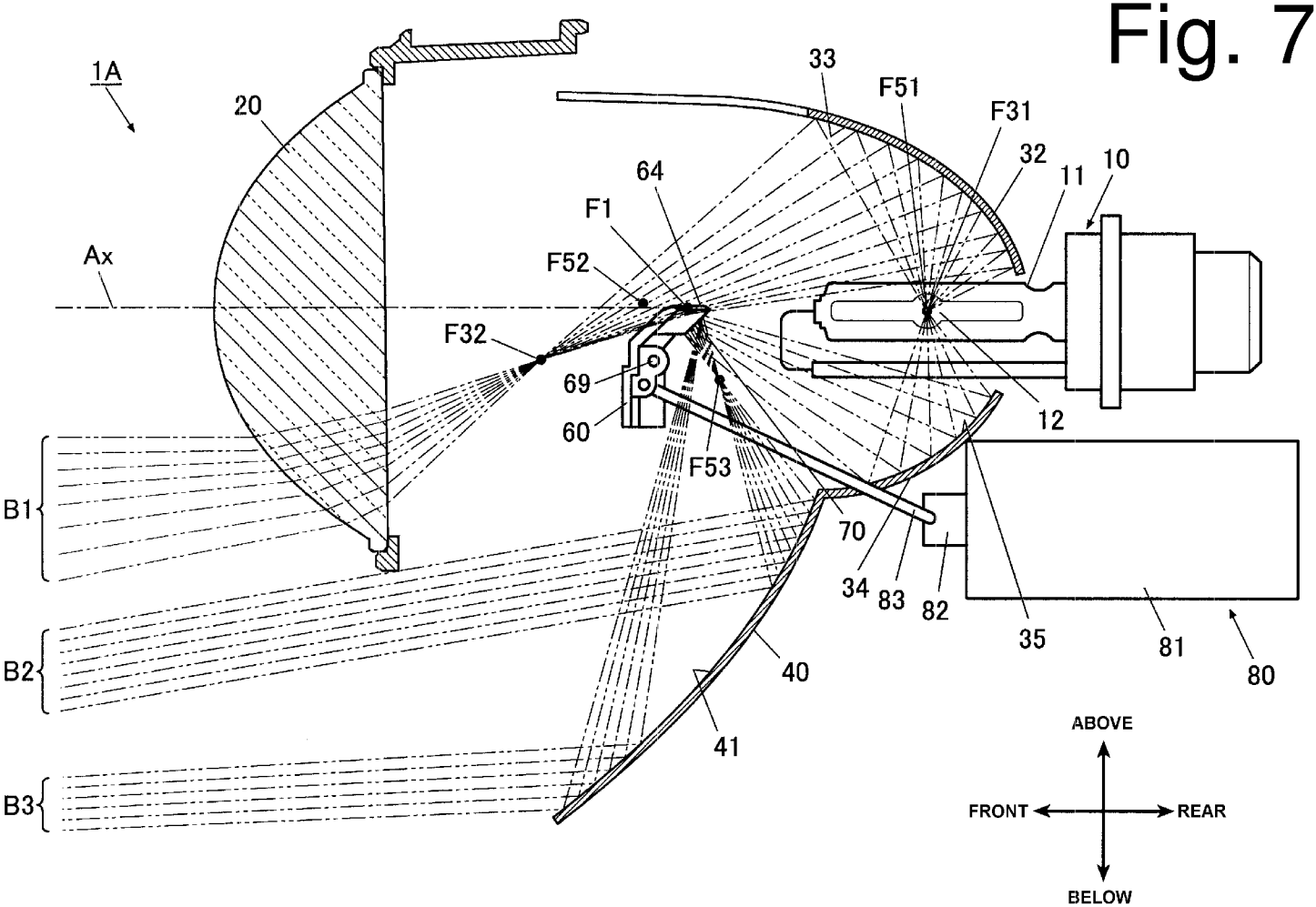
FIG. 7 is a cross sectional view of the vehicle light of FIG. 6 wherein the light-shielding member is located at a light-shielding position.
Figure 8:
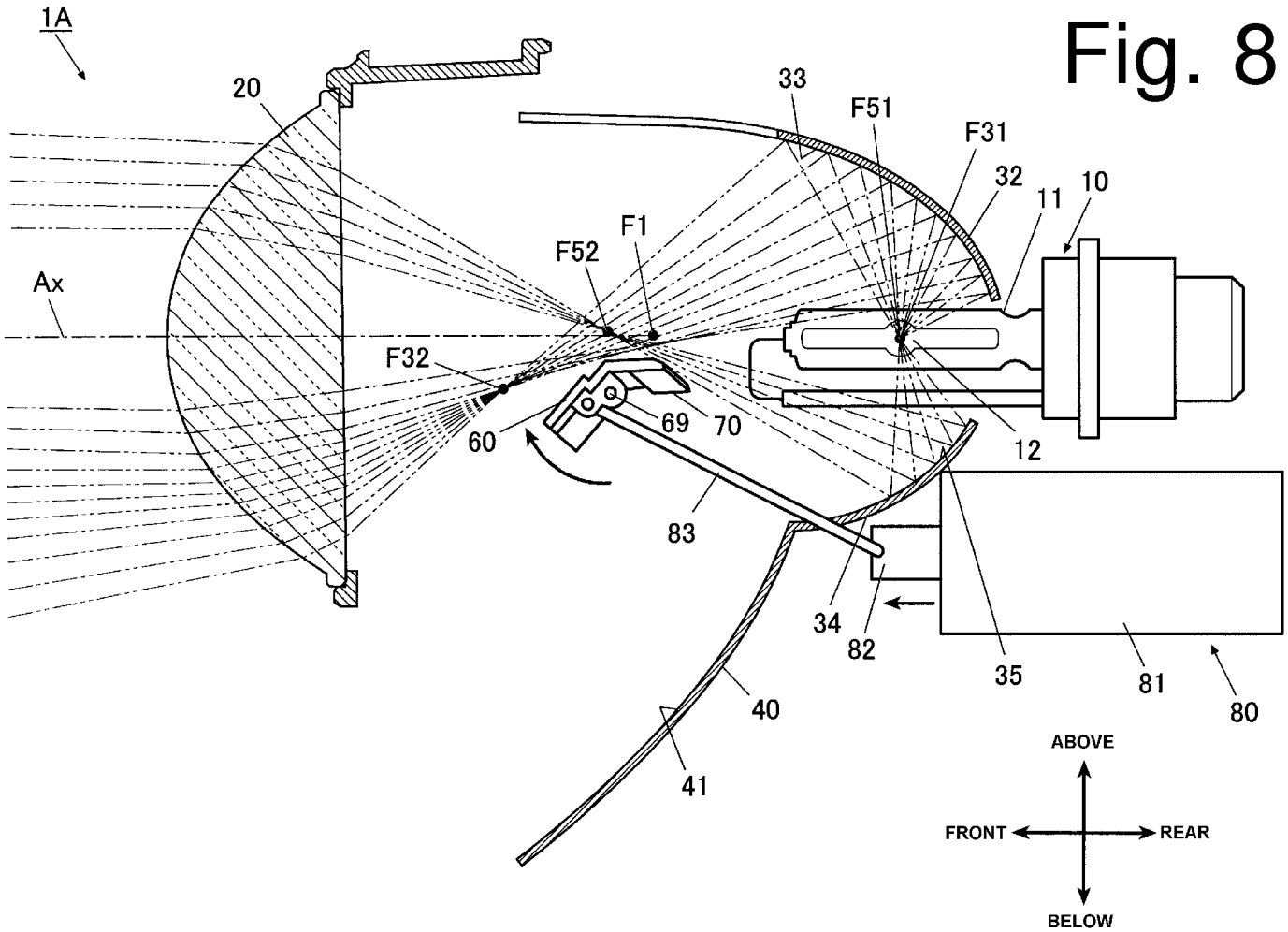
FIG. 8 is a cross sectional view of the vehicle light of FIG. 6 wherein the light-shielding member is located at a retracted position.

FIG. 6 is a front perspective view of a vehicle light 1A according to another exemplary embodiment. FIGS. 7 and 8 are vertical cross sectional views taken along the optical axis Ax. It should be noted that in FIGS. 6 to 8 the overhead-sign light distribution reflector 50 is not illustrated for the purpose of facilitating the understanding of the depicted portions of the exemplary embodiment of FIG. 6. However, this overhead-sign light distribution reflector 50 and components can easily be included in this embodiment.

The same or similar components of the vehicle light 1A in the exemplary embodiment of FIG. 6 may be denoted by the same numerals as those of the vehicle light 1 in the exemplary embodiment of FIG. 1, and the redundant descriptions therefor may be omitted hereinafter.

In the exemplary embodiment of FIG. 1, the shade 60 is fixed in an erected state so that the position of the second reflecting surface 70 is also fixed. On the contrary, in the exemplary embodiment of FIG. 6, in order to form a high beam light distribution pattern (for travelling), the shade 60 can be configured to be movable between a light-shielding position where the upper edge 64 thereof is located at or near the focus F1 of the projector lens 20 and a retracted position where the upper edge 64 thereof is located away from and below the focus F1 of the projector lens 20. Specifically, the shade 60 can be configured in the following manner. The shade 60 can be provided with a rotation shaft 69 extending horizontally. The rotation shaft 69 can be rotatably supported by a fixing member such as a housing (not shown), whereby the shade 60 can rotate around the rotation shaft 69.

When the shade 60 is in an erected state or the shade 60 is located at a light-shielding position, the upper edge 64 of the shade 60 can be located at or near the focus F1 of the projector lens 20. This is the same state as that in the exemplary embodiment of FIG. 1 wherein the shade 60 is securely fixed. On the other hand, when the shade 60 is inclined backward around the rotation shaft 69 or the shade 60 is located at a retracted position, the upper edge 64 of the shade 60 can be located behind the focus F1 of the projector lens 20 and obliquely downward.

Furthermore, the vehicle light 1A can include a driving mechanism 80 for driving the shade 60 between the light-shielding position and the retracted position. The driving mechanism 80 can include a solenoid 81 and an arm 83, for example. The solenoid 81 can be attached to the fixing member such as the housing (not shown) and disposed below the lower reflector 34. The solenoid 81 can include a plunger 82 and can be disposed such that the plunger 82 thereof is directed forward. The solenoid 81 can be configured to move the plunger 82 forward and backward. The tip end of the plunger 82 can be connected to one end of the arm 83 so that the arm 83 can freely swing. The other end of the arm 83 can be connected to the shade 60 so that the arm 83 can freely swing.

The other components of the vehicle light 1A can be the same as or similar to those of the vehicle light 1 in the exemplary embodiment of FIG. 1, and accordingly, a description therefor will be omitted here.

Next, a description will be given of the operation of the shade 60 as configured above.

As shown in FIG. 7, when the plunger 82 of the solenoid 81 is retracted backward, the shade 60 can be located at the light-shielding position. In this state, the light distribution pattern as shown in FIG. 5 can be formed on the virtual screen.

When the plunger 82 of the solenoid 81 is pushed forward, the shade 60 can fall down backward around the rotation shaft 69. Then, if the shade 60 can move at the retracted position as shown in FIG. 8, the solenoid 81 can be stopped to stop the forward movement of the plunger 83.

Figure 9:
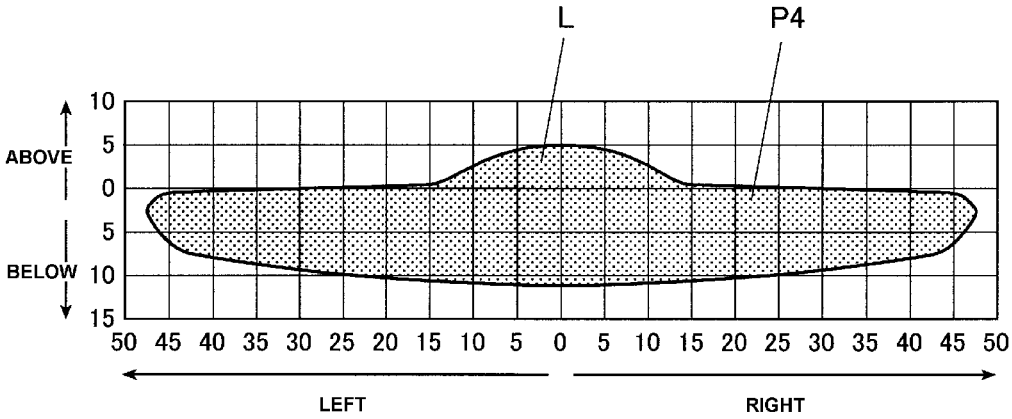
FIG. 9 is a chart showing a high beam light distribution pattern formed on the virtual screen in front of the vehicle light of FIG. 6.

As shown in FIG. 8, when the shade 60 is located at the retracted position, the light beams reflected by the first reflecting surface 31 cannot be shielded, and accordingly cannot be incident on the second reflecting surface 70. In this state, the light distribution pattern P4 as shown in FIG. 9 can be formed on the virtual screen. The light distribution pattern P4 can be used as a high beam light distribution pattern having a center bright area L located above the horizontal plane (at a vertical angle of 0 degrees).

When the plunger 82 of the solenoid 81 is withdrawn, the shade 60 can rotate around the rotation shaft 69 to be erect and forward. Then, the shade 60 can move to the light-shielding position, and the withdrawing action of the plunger 82 can be stopped.

As described above, the present exemplary embodiment can achieve the switch over between the provision of the low beam light distribution and the provision of the high beam light distribution while also providing the advantageous effects exerted by the exemplary embodiment of FIG. 1.

It should be noted that the power source for moving (rotating) the shade 60 is not limited to the solenoid 81, but may be another power source such as a motor, a piezoelectric device, and the like. For example, if a motor is used as a power source, the driving shaft of the motor can be connected with the rotation shaft 69 directly or via a gear box or the like

MODIFIED EXAMPLES

Exemplary embodiments to which the presently disclosed subject matter can be applied are not limited to those as described above, but may be modified appropriately without departing from the scope of the presently disclosed subject matter. Hereinafter, several modified examples will be described. The following modified examples (and earlier described embodiments) can be combined with each other and with the above described embodiments.

Modified Example 1

Figure 10:
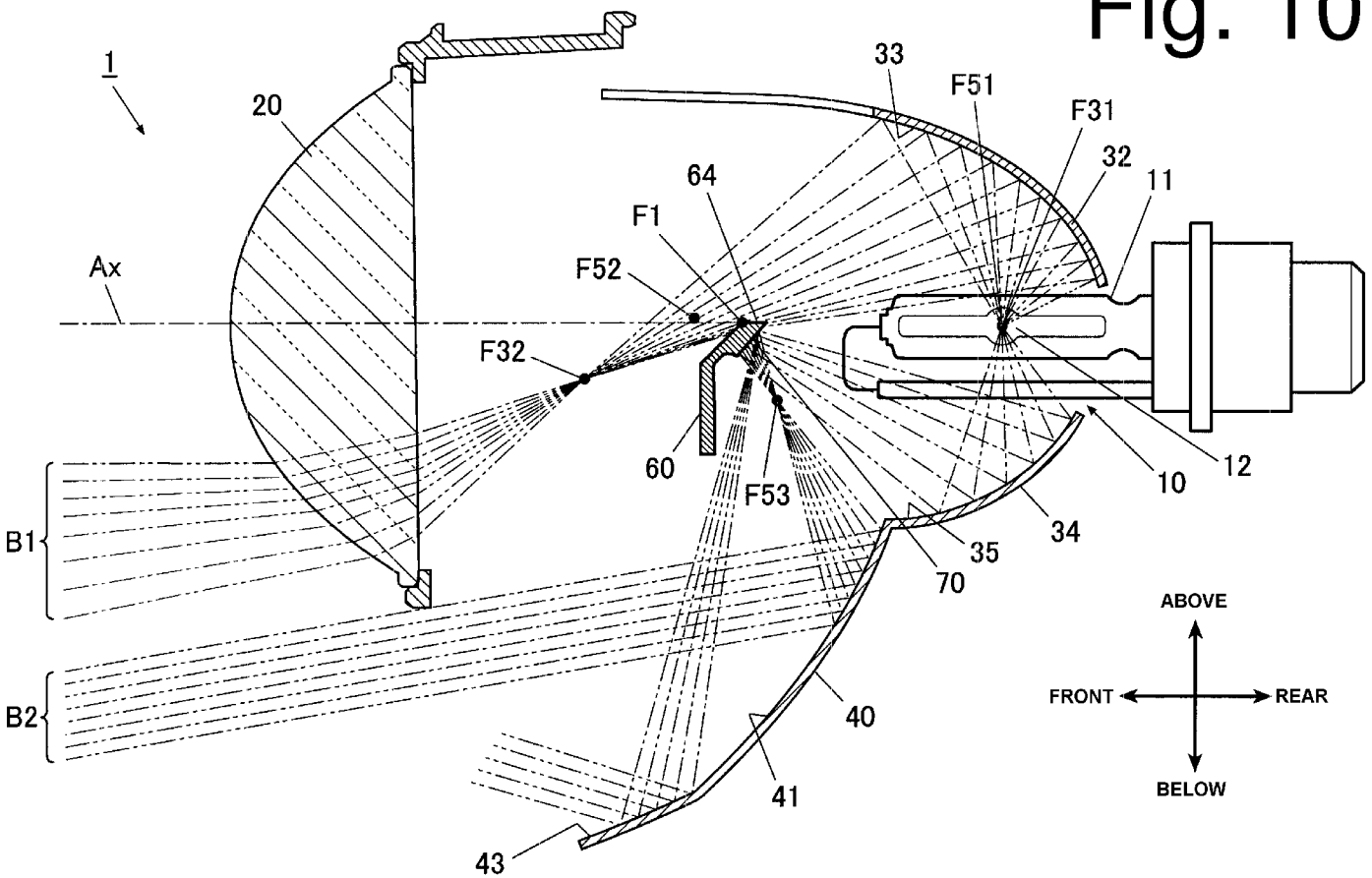
FIG. 10 is a cross sectional view of a vehicle light according to a modified example.

FIG. 10 is a cross sectional view of a vehicle light according to Modified Example 1, wherein an overhead-sign light distribution reflecting surface 43 can be formed at a front end area of the parabolic reflector 40. The reflecting surface 43 can be configured such that the light beams reflected by the second reflecting surface 70 can be reflected forward and upward over the horizontal plane. Specifically, the illustrated reflecting surface 43 can reflect light beams reflected both by the upper reflecting surface 33 and the second reflecting surface 70. In this configuration, the reflecting surface 43 can be configured to include a revolved paraboloid around a center rotation axis extending in the front-to-rear direction and inclined rearward or a free curved surface based on the revolved paraboloid. The reflecting surface 43 can have a focus at or near the second reflecting surface 70.

It should be noted that the reflecting surface 43 can be formed on the parabolic reflector 40 of the vehicle light 1A in the exemplary embodiment of FIG. 6. When this reflecting surface 43 is provided on the parabolic reflector 40, there is no need to include the overhead-sign light distribution reflector 50.

Modified Example 2

Figure 11:
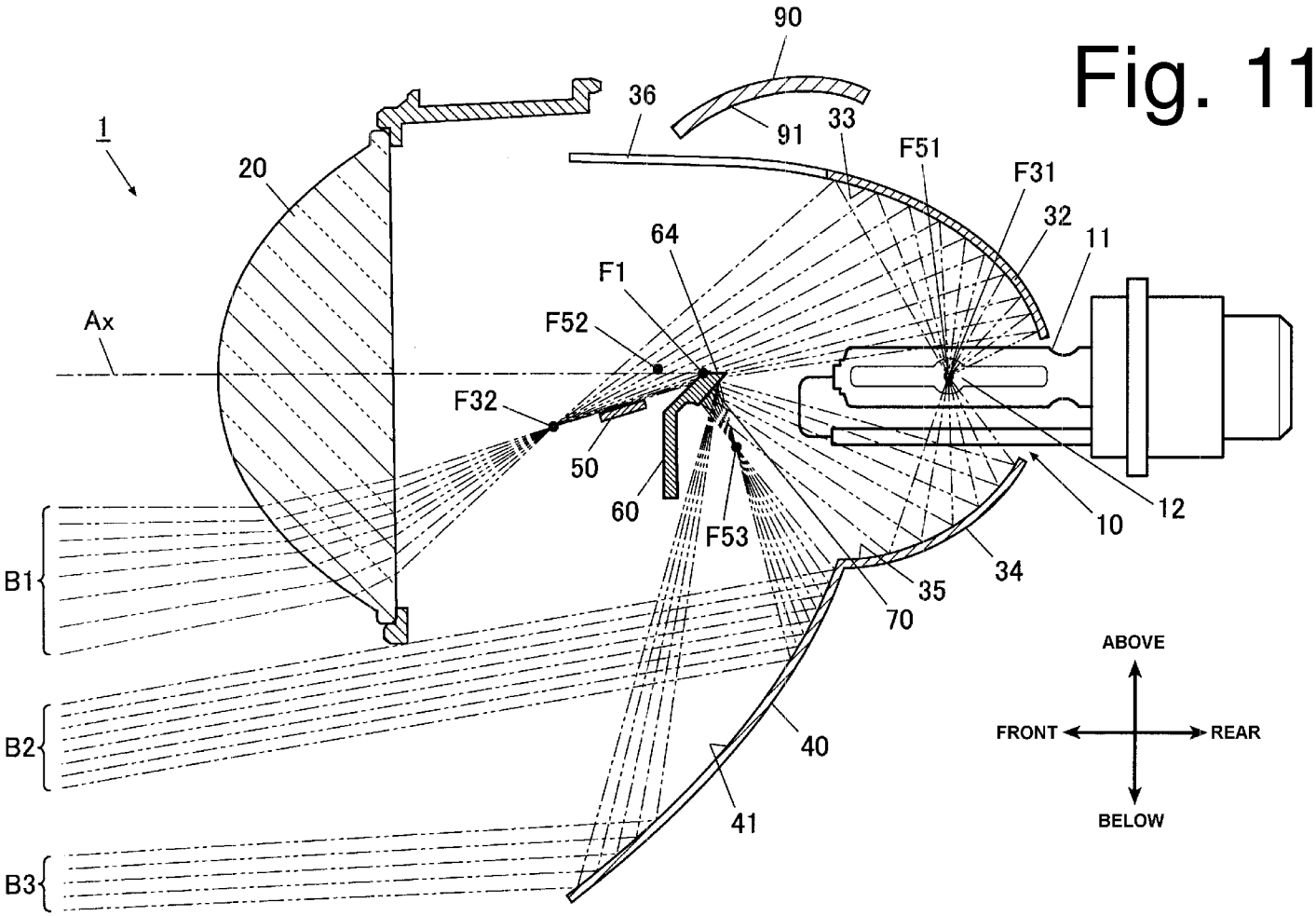
FIG. 11 is a cross sectional view of a vehicle light according to another modified example.

As shown in FIG. 1, the upper reflecting surface 33 is curved at its front edge 36 inwardly, so that a space can be formed in front of the front edge 36. In order to effectively utilize this space, as shown in FIG. 11 an additional reflector 90 can be provided in front of the front edge 36 of the upper reflecting surface 33. In this case, the additional reflector 90 can be configured to include an inner surface 91 serving as a reflecting surface that is directed downward. The reflecting surface 91 of the additional reflector 90 can be an ellipsoid having a first focus located at or near the light emission portion 12 and a second focus located at or near the third reflecting surface 41. The reflecting surface 91 of the additional reflector 90 can receive direct light beams from the light emission portion 12 to reflect the same toward the third reflecting surface 41 disposed therebelow. Then, the reflected light beams can enter the third reflecting surface 41 and be reflected forward by the same to be projected through the area below the projector lens 20.

It should be noted that the reflector 90 can also be provided on the vehicle light 1A of the exemplary embodiment of FIG. 6.

Modified Example 3

In the above-described exemplary embodiments, the second reflecting surface 70 can reflect the light beams reflected from the first reflecting surface 31 to direct the same downward. However, the direction of light beams reflected by the second reflecting surface 70 is not limited thereto. For example, the direction of light beams reflected by the second reflecting surface 70 may be a direction radially outward with respect to the optical axis Ax, upward, leftward, or rightward. Accordingly, the third reflecting surface 41 can be disposed at various positions corresponding to the direction of light beams reflected by the second reflecting surface 70. Specifically, when the second reflecting surface 70 is configured to reflect light beams upward, the third reflecting surface 41 can be disposed above the shade 60. When the second reflecting surface 70 is configured to reflect light beams leftward, the third reflecting surface 41 can be disposed on the left side of the shade 60. When the second reflecting surface 70 is configured to reflect light beams rightward, the third reflecting surface 41 can be disposed on the right side of the shade 60.

Further, when the third reflecting surface 41 is disposed above the shade 60, the third reflecting surface 41 can reflect the light beams reflected by the second reflecting surface 70 forward so that the reflected light beams can pass above the projector lens 20 to be projected forward. When the third reflecting surface 41 is disposed on the left side of the shade 60, the third reflecting surface 41 can reflect the light beams reflected by the second reflecting surface 70 forward so that the reflected light beams can pass by the left side of the projector lens 20 to be projected forward. When the third reflecting surface 41 is disposed on the right side of the shade 60, the third reflecting surface 41 can reflect the light beams reflected by the second reflecting surface 70 forward so that the reflected light beams can pass by the right side of the projector lens 20 to be projected forward.

Modified Example 4

In the above described exemplary embodiment of FIG. 6, the shade 60 can swing forward and backward around the rotation shaft 69. In an alternative example, the shade 60 can be moved up and down by a linear guide mechanism or the like. In this case, the shade 60 can be elevated and stopped when the shade 60 reaches a position where the upper edge 64 of the shade 60 is located at or near the focus F1 of the projection lens 20. On the other hand, the shade 60 can be lowered and stopped when the upper edge 64 of the shade 60 is located below and away from the focus F1 of the projection lens 20. The drive mechanism 80 can be appropriately changed in design to elevate and lower the shade 60.

Modified Example 5

The third reflecting surface 41 can be inclined leftward or rightward to shift the bright area of the light distribution pattern P2 slightly leftward or rightward when compared with the pattern P2 shown in FIG. 5. Furthermore, the third reflector surface 41 can be inclined forward so that the bright area of the light distribution pattern P2 can be shifted downward when compared with the pattern P2 shown in FIG. 5.

Modified Example 6

In the exemplary embodiment of FIG. 1, the vehicle light 1 is applied to a vehicle headlamp, but the presently disclosed subject matter is not limited thereto. Other examples of the lamp of the presently disclosed subject matter include a fog lamp, a signal lamp, a turning lamp, a rear lamp, and the like. In particular, when the lamp 1 is applied to a fog lamp, the upper edge of the shade 60, the curved surface of the first reflecting surface 31, the curved surfaces of the light incident side and light projecting side of the projector lens 20, the curved surface of the third reflecting surface 41, and the like can be appropriately designed so that the lamp can satisfy the requirements for a fog lamp.

It will be apparent to those skilled in the art that various modifications and variations can be made in the presently disclosed subject matter without departing from the spirit or scope of the presently disclosed subject matter. Thus, it is intended that the presently disclosed subject matter cover the modifications and variations of the presently disclosed subject matter provided they come within the scope of the appended claims and their equivalents. All related art references described above are hereby incorporated in their entirety by reference.

What is claimed is:

1. A vehicle light comprising:

a light source;

a projector lens located in front of the light source, the projector lens having an optical axis in a front-to-rear direction of a vehicle body to which the vehicle light is configured to be installed, the projector lens having a focus located in between the light source and the projector lens;

a first reflecting surface located rearward of the projector lens, the first reflecting surface configured to reflect light beams emitted from the light source toward the projector lens so that reflected light beams are converged substantially at the focus of the projector lens;

a light-shielding member including an upper edge configured to be located substantially at the focus of the projector lens, the light-shielding member also configured to shield a portion of the reflected light beams directed from the first reflecting surface to the projector lens;

a second reflecting surface located on a rear surface of the light-shielding member and configured to reflect a portion of the reflected light beams directed from the first reflecting surface to the projector lens so as to direct the light beams in a direction outward from the optical axis of the projector lens; and a third reflecting surface located in a direction outward from the optical axis of the projector lens, the third reflecting surface configured to reflect the light beams reflected by the second reflecting surface to an outside area around and below the projector lens to project the light beams forward.

2. The vehicle light according to claim 1, wherein:

the second reflecting surface is configured to reflect the portion of the reflected light beams that are directed from the first reflecting surface to the projector lens so as to direct the light beams downward; and the third reflecting surface is located below the light-shielding member so as to reflect the light beams reflected by the second reflecting surface to an outside area below the projector lens to project the light beams forward.

3. The vehicle light according to claim 2, wherein the light-shielding member is configured to be movable between a light-shielding position where the upper edge of the light-shielding member is located substantially at the focus of the projector lens and a retracted position where the upper edge of the light-shielding member is located away from and below the focus of the projector lens.

4. The vehicle light according to claim 3, further comprising a driving mechanism configured to move the light-shielding member between the light-shielding position and the retracted position.

5. The vehicle light according to claim 1, wherein the light-shielding member is configured to be movable between a light-shielding position where the upper edge of the light-shielding member is located substantially at the focus of the projector lens and a retracted position where the upper edge of the light-shielding member is located away from and below the focus of the projector lens.

6. The vehicle light according to claim 5, further comprising a driving mechanism configured to move the light-shielding member between the light-shielding position and the retracted position.

7. The vehicle light according to claim 1, further comprising an overhead reflecting surface configured to form an overhead-sign light distribution during operation of the vehicle light, the overhead reflecting surface located between the light-shielding member and the projector lens such that during operation of the vehicle light the overhead reflecting surface reflects a portion of the reflected light beams not shielded by the light-shielding member.

8. The vehicle light according to claim 1, further comprising an overhead reflecting surface configured to form an overhead-sign light distribution during operation of the vehicle light, the overhead reflecting surface located at a front end area of the third reflecting surface such that during operation of the vehicle light the overhead reflecting surface reflects a portion of the reflected light beams reflected by the second light reflecting surface.

9. The vehicle light according to claim 1, wherein the first reflecting surface has an inwardly-curved front edge so that a space is formed in front of the front edge, and wherein the vehicle light further comprises an additional reflecting surface disposed in the space in front of the front edge of the first reflecting surface such that during operation of the vehicle light the additional reflecting surface reflects light beams received directly from the light source to the third reflecting surface to project the light beams forward.

10. A vehicle light comprising:

a light source;

a projector lens located in front of the light source, the projector lens having an optical axis in a front-to-rear direction of the vehicle light, the projector lens having a focus located in between the light source and the projector lens;

a first reflecting surface located rearward of the projector lens, the first reflecting surface configured to reflect light beams, emitted from the light source, toward the projector lens and to converge the light beams substantially at the focus of the projector lens;

a light-shielding member including an upper edge configured to be located substantially at the focus of the projector lens, the light-shielding member also having a surface configured to shield a portion of the reflected light beams received from the first reflecting surface, the surface also configured to reflect the portion of the reflected light beams received from the first reflecting surface so as to direct the reflected light beams in a direction outward from the optical axis of the projector lens; and a third reflecting surface located in a direction outward from the optical axis of the projector lens, the third reflecting surface configured to reflect the light beams received from the surface of the light shielding member to an outside area below the projector lens to project the reflected light beams forward with the entire projector lens being spaced from the light beams reflected by the third reflecting surface.

11. The vehicle light according to claim 10, further comprising:

an overhead sign light distribution reflector located between the projector lens and the light shielding member.

12. The vehicle light according to claim 10, wherein the light-shielding member is configured to be movable between a light-shielding position where the upper edge of the light-shielding member is located substantially at the focus of the projector lens and a retracted position where the upper edge of the light-shielding member is located away from and below the focus of the projector lens.

13. The vehicle light according to claim 12, further comprising a drive mechanism connected to the light-shielding member.

14. The vehicle light according to claim 10, further comprising:

an additional reflector completely separate from and spaced from the first reflecting surface, the additional reflector located above the first reflecting surface and the light-shielding member.

* * * * *